US008726555B2

(12) United States Patent
Carr

(10) Patent No.: US 8,726,555 B2
(45) Date of Patent: May 20, 2014

(54) MAGAZINE SAFETY ASSEMBLY

(75) Inventor: Jesse Daniel Carr, Fremont, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 13/453,369

(22) Filed: Apr. 23, 2012

(65) Prior Publication Data

US 2012/0291325 A1 Nov. 22, 2012

Related U.S. Application Data

(60) Provisional application No. 61/478,245, filed on Apr. 22, 2011.

(51) Int. Cl.
*F41A 17/36* (2006.01)

(52) U.S. Cl.
USPC ..... 42/70.02

(58) Field of Classification Search
USPC ..... 42/70.01, 70.02, 70.11, 108, 70.05, 7, 42/70.08; 89/137, 147, 150, 138
See application file for complete search history.

(56) References Cited

U.S. PATENT DOCUMENTS

| | | | | |
|---|---|---|---|---|
| 984,519 | A | | 2/1911 | Browning |
| 2,459,838 | A | | 1/1949 | Quinn et al. |
| 4,031,648 | A | * | 6/1977 | Thomas ..... 42/70.02 |
| 4,291,481 | A | | 9/1981 | Hillberg |
| 4,428,138 | A | * | 1/1984 | Seecamp ..... 42/70.02 |
| 5,222,612 | A | | 6/1993 | Binder |
| 5,388,362 | A | | 2/1995 | Melcher |
| 5,438,784 | A | | 8/1995 | Lenkarski et al. |
| 6,096,618 | A | | 8/2000 | Dunn et al. |
| 6,420,669 | B1 | | 7/2002 | Shenker et al. |
| 6,457,271 | B1 | | 10/2002 | Vaid et al. |
| 6,519,887 | B1 | | 2/2003 | Allen et al. |
| 6,655,066 | B2 | * | 12/2003 | Fluhr ..... 42/70.02 |
| 6,952,895 | B1 | | 10/2005 | Zonshine |

* cited by examiner

*Primary Examiner* — Samir Abdosh
*Assistant Examiner* — John D Cooper
(74) *Attorney, Agent, or Firm* — Finch & Maloney PLLC

(57) ABSTRACT

A magazine safety assembly configured for use in a firearm includes a pivot point assembly. A lever assembly, including a first portion and a second portion, is configured to pivot about the pivot point assembly from an engaged position to a disengaged position. When positioned in the engaged position, the first portion of the lever assembly releasably engages a trigger assembly of the firearm. When positioned in the disengaged position, the second portion of the lever assembly releasably engages an ammunition magazine assembly positioned within a magazine well of the firearm. A spring assembly is configured to bias the lever assembly into the engaged position when the ammunition magazine assembly is not positioned within the magazine well the firearm.

20 Claims, 9 Drawing Sheets

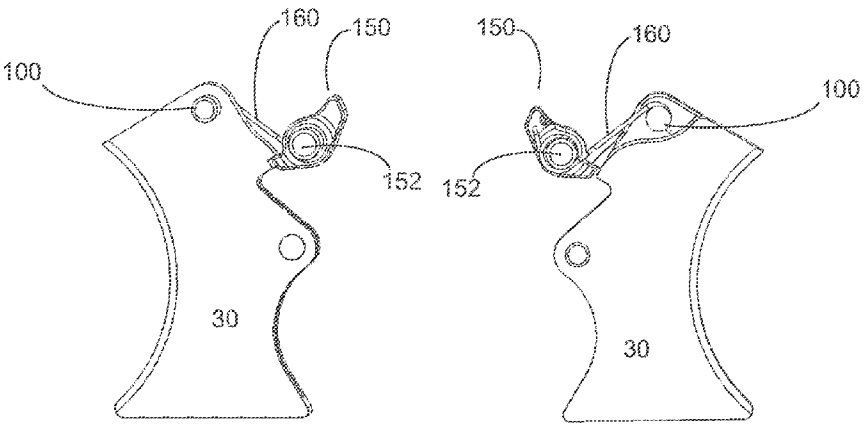
FIG. 7A (Left Side)
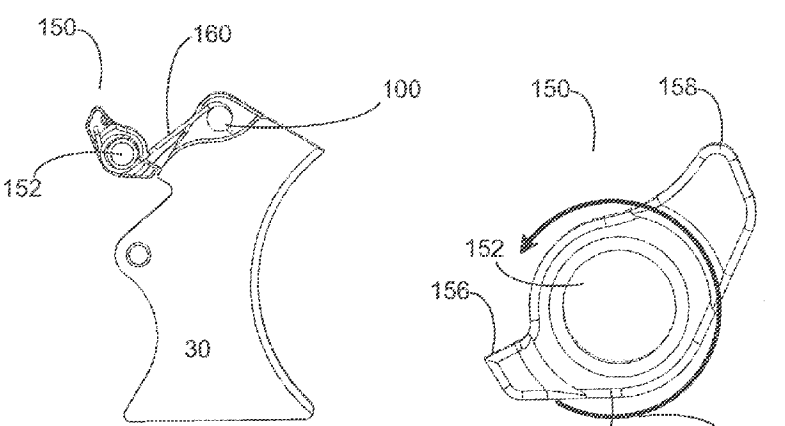
FIG. 7C (Right Side)
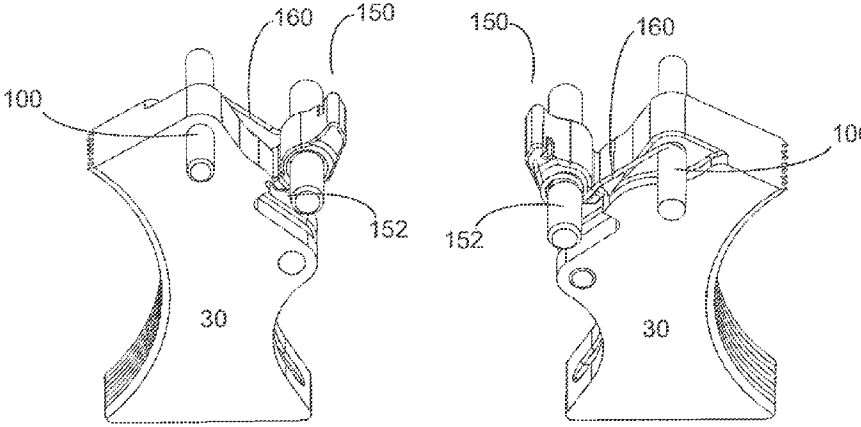
FIG. 7B (Left Side)
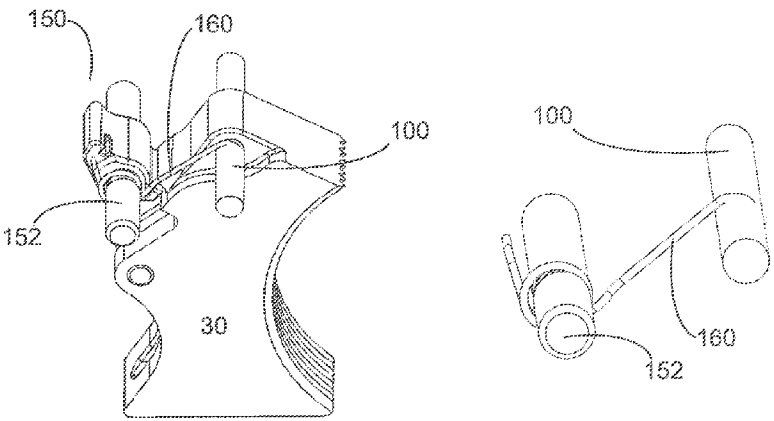
FIG. 7D (Right Side)
FIG. 7E
FIG. 7

MAGAZINE SAFETY ASSEMBLY

CROSS-REFERENCE TO RELATED APPLICATION

This application claims the benefit of U.S. Provisional Patent Application Ser. No. 61/478,245, filed 22 Apr. 2011, the entire contents of which are incorporated herein by reference.

TECHNICAL FIELD

This disclosure relates to firearm safety assemblies and, more particularly to magazine safety assemblies for use within firearms.

BACKGROUND

Firearms often employ various safety devices to prevent the inadvertent and unexpected discharge of the firearm. For example, firearms typically employ passive trigger safeties that prevent the firearm from discharging due to inertia on the trigger in the event that e.g., the firearm is dropped. Additionally, more active safeties (e.g., thumb safeties) may be utilized that require the user to disengage the safety prior to discharging the weapon.

As is known in the art, some firearms utilize detachable magazines, wherein the magazine may be removed while a round is chambered within the firearm. Accordingly and on such a firearm, the firearm may be discharged without a magazine being loaded within the firearm. While some users (especially tactical and military users) prefer allowing the firearm to be discharged while the magazine is removed from the firearm, some jurisdictions (such as California) and some users prefer to prohibit the discharge of the firearm when the magazine is removed from the firearm. Accordingly, magazine safety assemblies may be utilized to prohibit the firearm from discharging when the magazine is removed from the firearm. Unfortunately, such magazine safeties typically decouple the trigger assembly from the firing system within the firearm. Accordingly, such systems may allow the displacement of the trigger assembly (in a manner similar to when the firearm is fireable) when the magazine safety assembly is engaged and would actually prohibit the firearm from discharging.

SUMMARY OF DISCLOSURE

In a first implementation, a magazine safety assembly configured for use in a firearm includes a pivot point assembly. A lever assembly, including a first portion and a second portion, is configured to pivot about the pivot point assembly from an engaged position to a disengaged position. When positioned in the engaged position, the first portion of the lever assembly releasably engages a trigger assembly of the firearm. When positioned in the disengaged position, the second portion of the lever assembly releasably engages an ammunition magazine assembly positioned within a magazine well of the firearm. A spring assembly is configured to bias the lever assembly into the engaged position when the ammunition magazine assembly is not positioned within the magazine well of the firearm.

One or more of the following features may be included. The lever assembly may be configured to be displaced from the engaged position to the disengaged position when the ammunition magazine assembly is inserted into the magazine well of the firearm. The first portion of the lever assembly may be configured to directly engage the trigger assembly of the firearm. The first portion of the lever assembly may be configured to prohibit displacement of the trigger assembly of the firearm when the lever assembly is in the engaged position. The first portion of the lever assembly may be configured to disengage the trigger assembly of the firearm when the lever assembly is positioned in the disengaged position. The pivot point assembly may include a pin assembly.

The firearm further may include a linkage assembly for coupling the trigger assembly to a hammer assembly included within the firearm. The linkage assembly may include a trigger bar and a sear assembly. The firearm may be a handgun.

In another implementation, a firearm includes a linkage assembly for coupling a trigger assembly to a hammer assembly. A lever assembly, including a first portion and a second portion, is configured to pivot from an engaged position to a disengaged position. When positioned in the engaged position, the first portion of the lever assembly releasably engages the trigger assembly of the firearm. When positioned in the disengaged position, the second portion of the lever assembly releasably engages an ammunition magazine assembly positioned within a magazine well of the firearm. A spring assembly is configured to bias the lever assembly into the engaged position when the ammunition magazine assembly is not positioned within the magazine well of the firearm.

One or more of the following features may be included. The lever assembly may be configured to be displaced from the engaged position to the disengaged position when the ammunition magazine assembly is inserted into the magazine well of the firearm. The first portion of the lever assembly may be configured to directly engage the trigger assembly of the firearm. The first portion of the lever assembly may be configured to prohibit displacement of the trigger assembly of the firearm when the lever assembly is in the engaged position. The first portion of the lever assembly may be configured to disengage the trigger assembly of the firearm when the lever assembly is positioned in the disengaged position. The linkage assembly may include a trigger bar and a sear assembly. The firearm may be a handgun.

In another implementation, a magazine safety assembly configured for use in a firearm includes a lever assembly configured to pivot from an engaged position to a disengaged position. When positioned in the engaged position, the lever assembly releasably engages a trigger assembly of the firearm. When positioned in the disengaged position, the lever assembly releasably engages an ammunition magazine assembly positioned within a magazine well of the firearm and disengages the trigger assembly of the firearm. A spring assembly is configured to bias the lever assembly into the engaged position when the ammunition magazine assembly is not positioned within the magazine well of the firearm.

One or more of the following features may be included. The lever assembly may be configured to be displaced from the engaged position to the disengaged position when the ammunition magazine assembly is inserted into the magazine well of the firearm. The lever assembly may be configured to directly engage the trigger assembly of the firearm. The lever assembly may be configured to prohibit displacement of the trigger assembly of the firearm when the lever assembly is in the engaged position. The firearm further may include a linkage assembly for coupling the trigger assembly to a hammer assembly included within the firearm. The linkage assembly may include a trigger bar and a sear assembly.

The details of one or more implementations are set forth in the accompanying drawings and the description below. Other features and advantages will become apparent from the description, the drawings, and the claims.

BRIEF DESCRIPTION OF THE DRAWINGS

FIGS. 7A-7E are detail views of the magazine safety assembly of FIG. 1;

Like reference symbols in the various drawings indicate like elements.

DETAILED DESCRIPTION OF THE PREFERRED EMBODIMENTS

Figure 1:
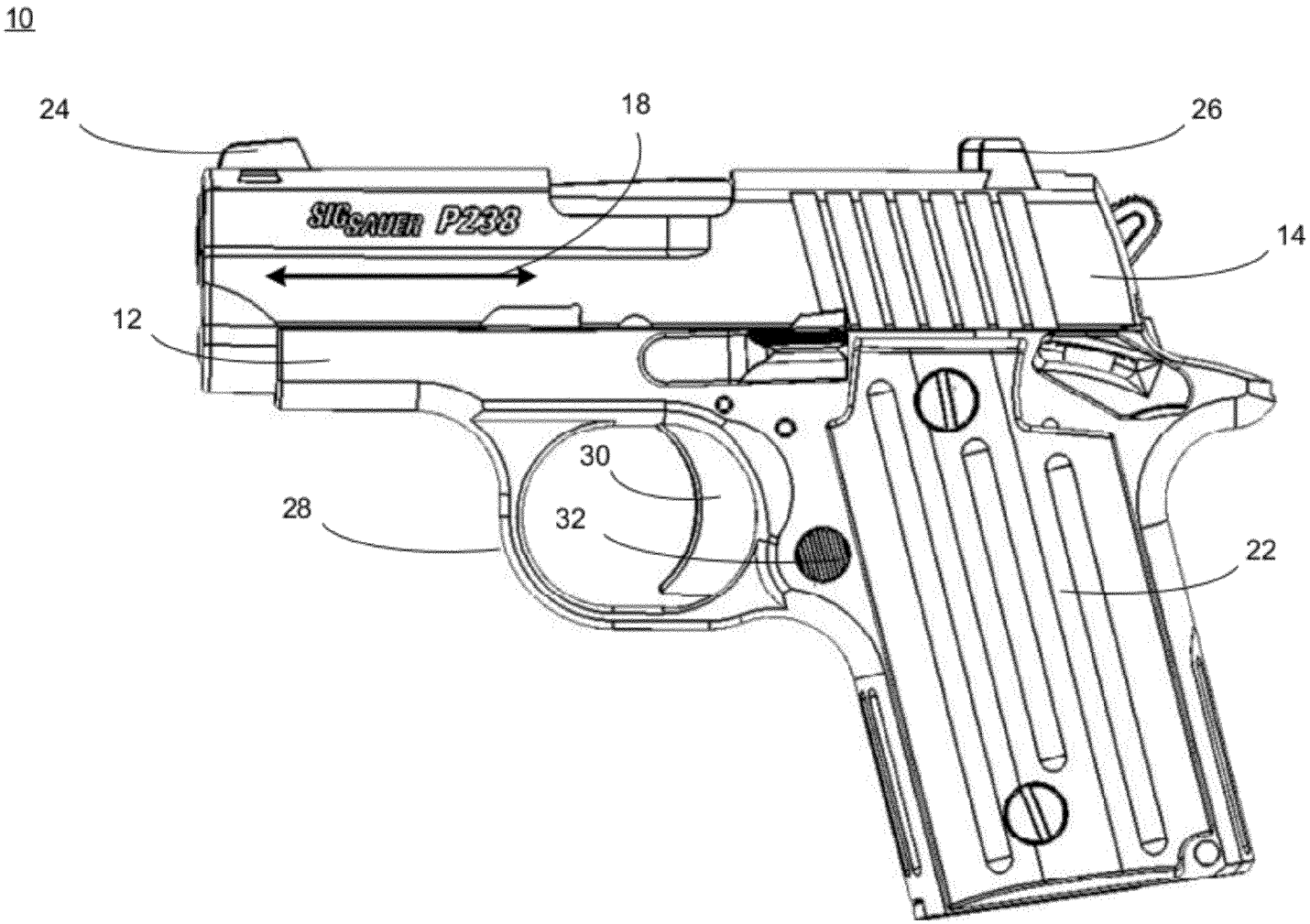
FIG. 1 is a diagrammatic view of a firearm including a magazine safety assembly.
Figure 2:
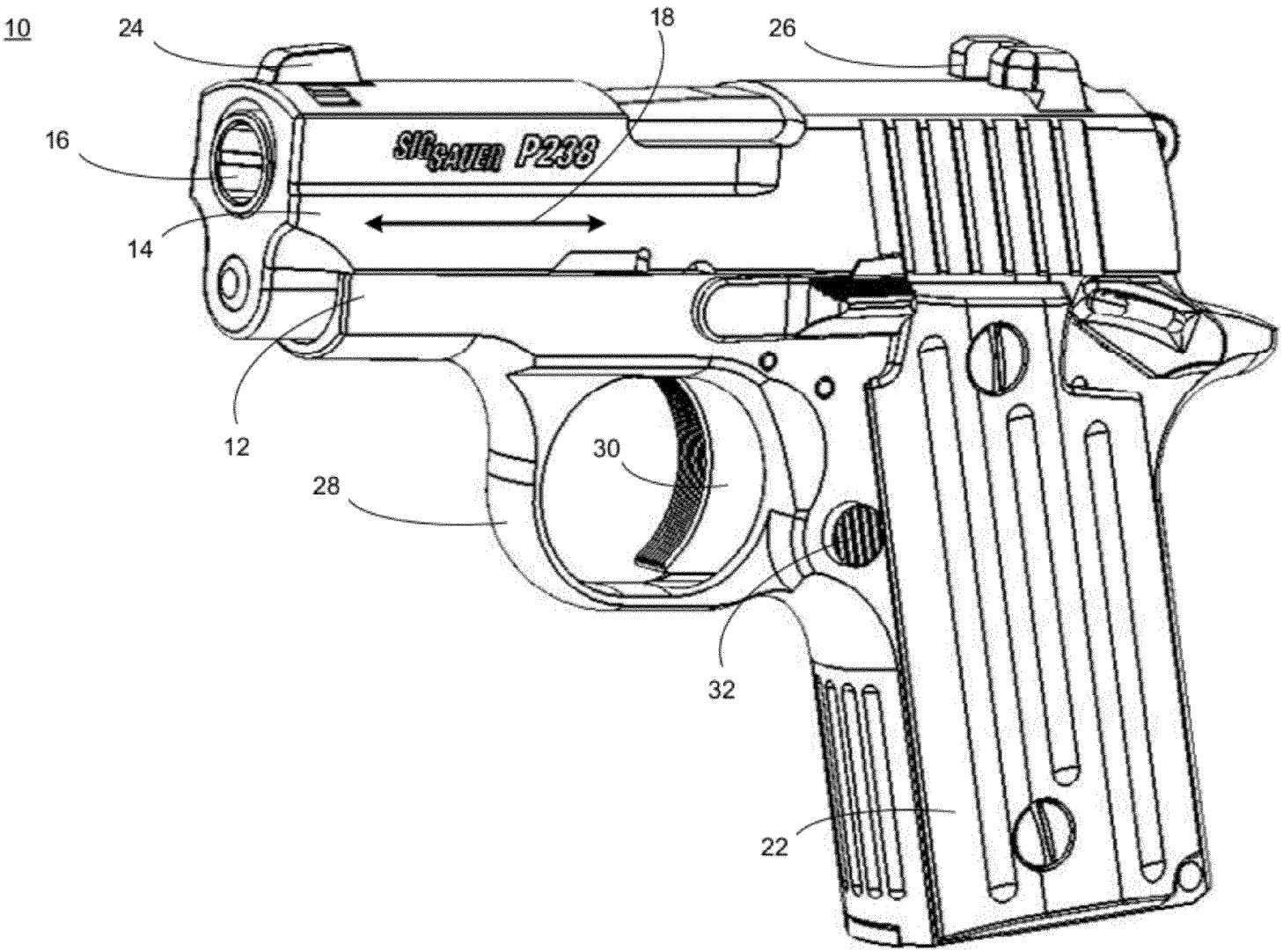
FIG. 2 is another diagrammatic view of the firearm including the magazine safety assembly of FIG. 1.
Figure 3:
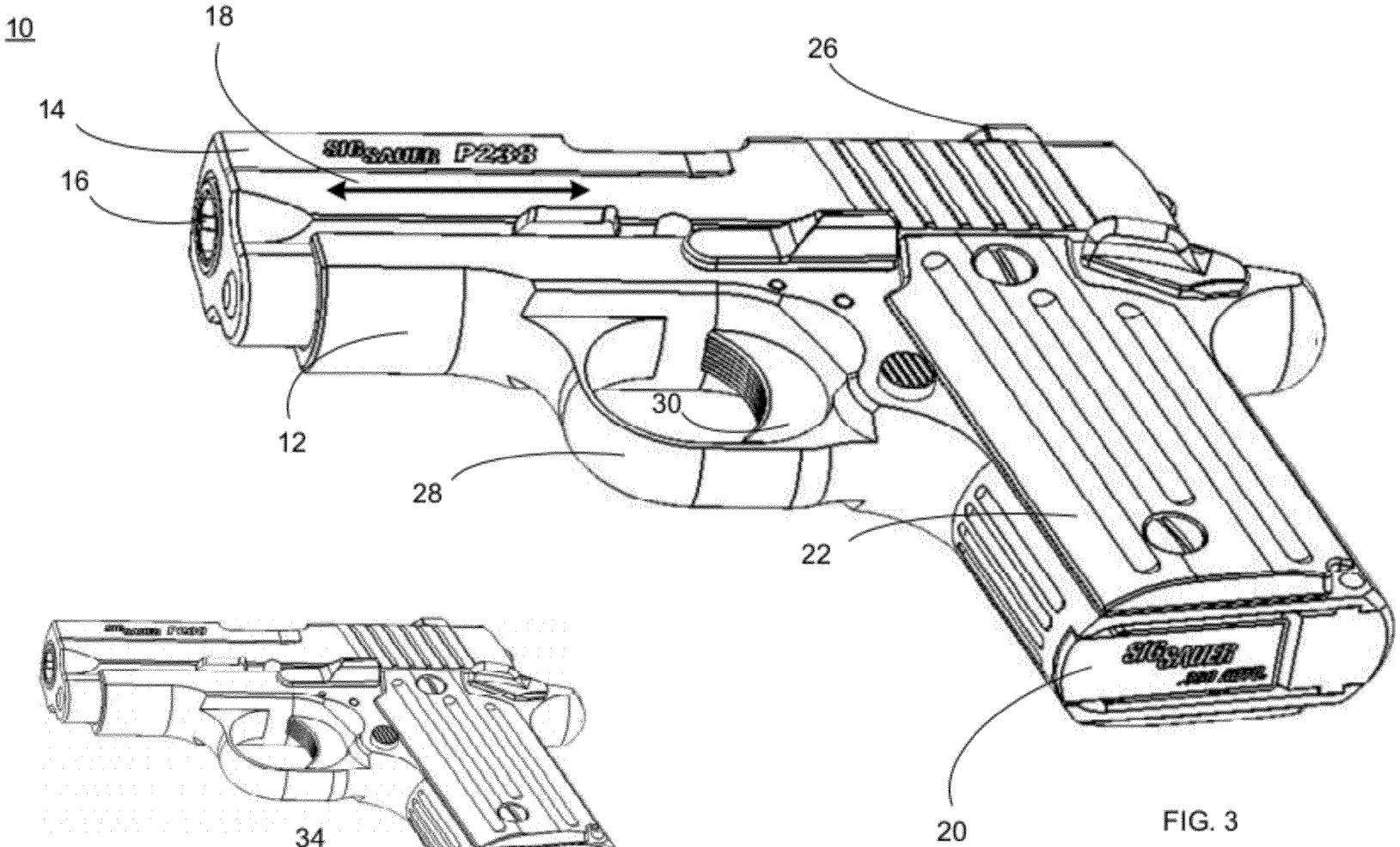
FIG. 3 is another diagrammatic view of the firearm including the magazine safety assembly of FIG. 1.

Referring to FIGS. 1-3, there is shown firearm 10. Examples of firearm 10 may include but are not limited to a semiautomatic handgun. However, the subject disclosure may be applicable to any firearm having a detachable ammunition magazine assembly.

Figure 3A:
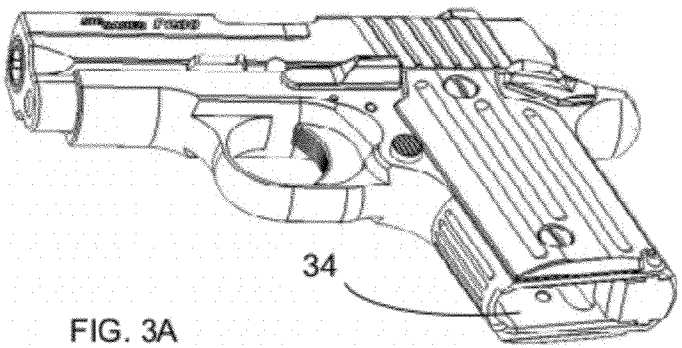
FIG. 3A is another diagrammatic view of the firearm of FIG. 1 with the ammunition magazine assembly removed.

Firearm 10 may include frame assembly 12 and slide assembly 14, which may surround barrel assembly 16 and cycle in the direction of arrow 18 to load ammunition from ammunition magazine assembly 20 into the chamber (not shown) of firearm 10. Firearm 10 may include grip assembly 22, which may be configured to receive ammunition magazine assembly 20. Firearm 10 may further include front sight assembly 24 and rear sight assembly 26 to aid in aiming firearm 10. Firearm 10 may further include trigger guard 28 that may be configured to shield trigger assembly 30, thus preventing the accidental displacement of trigger assembly 30. Magazine release assembly 32 may be included within firearm 10 to allow for the removal of ammunition magazine assembly 20 from magazine well 34 (as shown in FIG. 3A).

Figure 4:
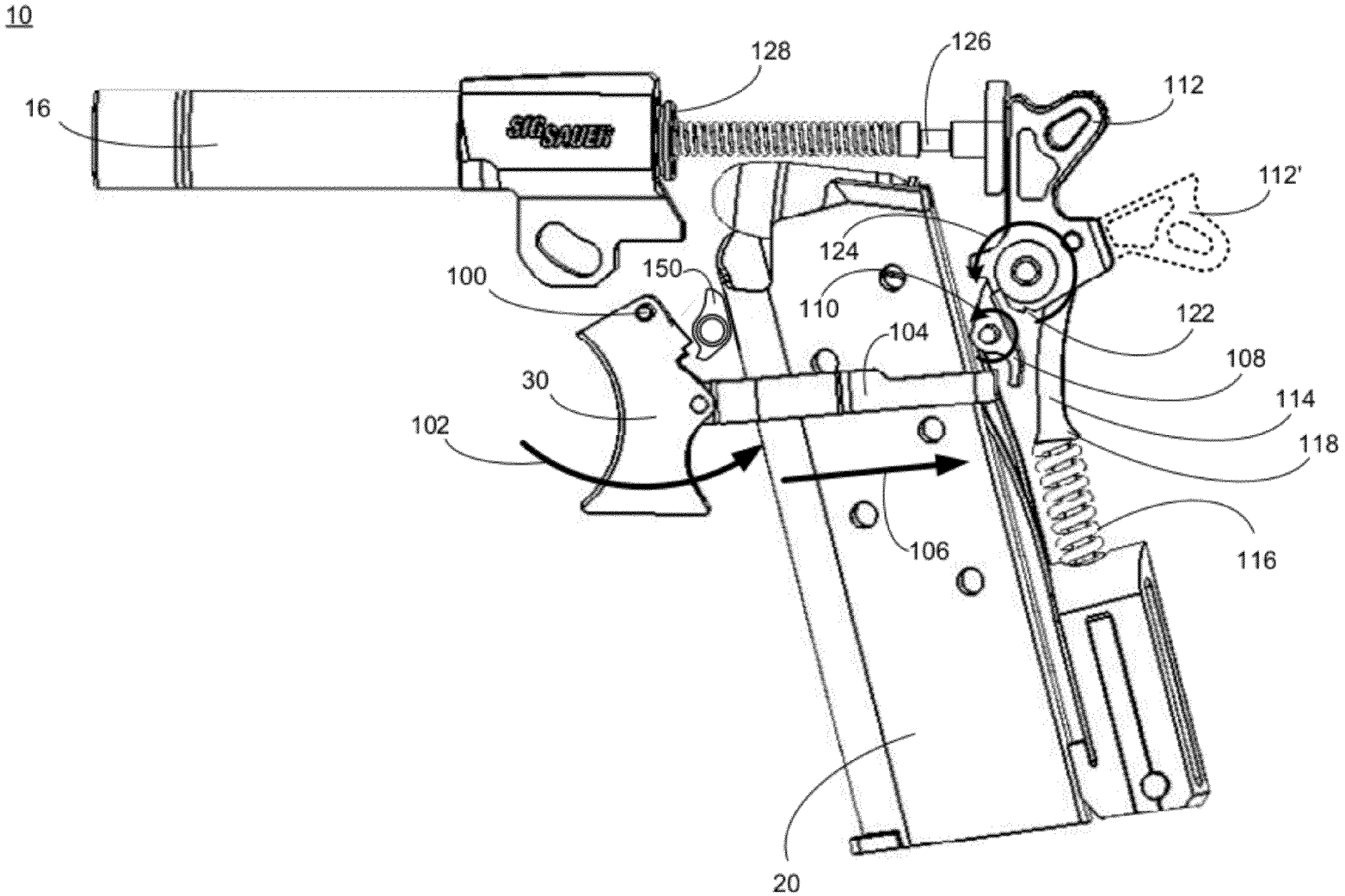
FIG. 4 is a detail view of the firearm including the magazine safety assembly of FIG. 1.
Figure 5:
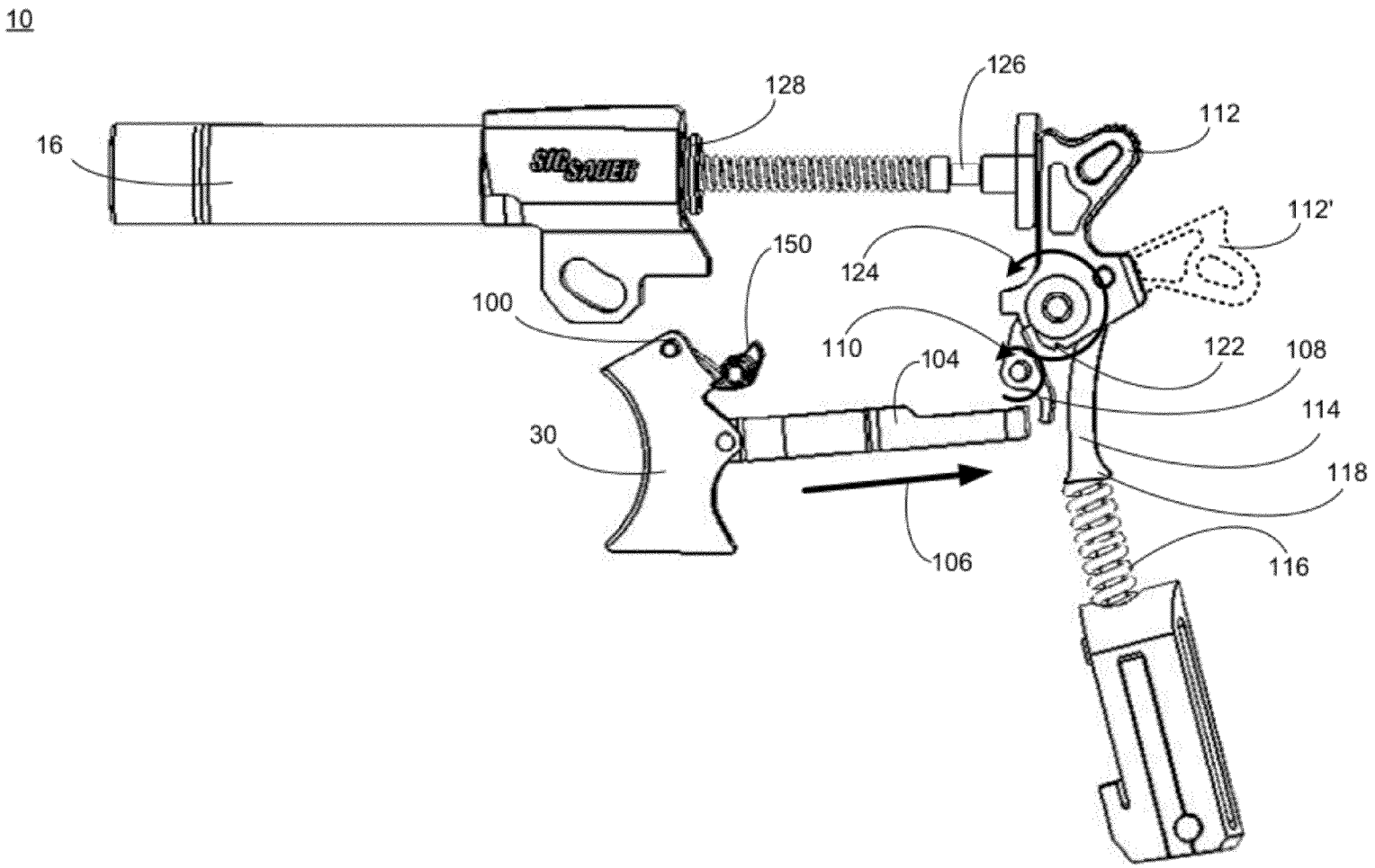
FIG. 5 is another detail view of the firearm including the magazine safety assembly of FIG. 1.
Figure 6:
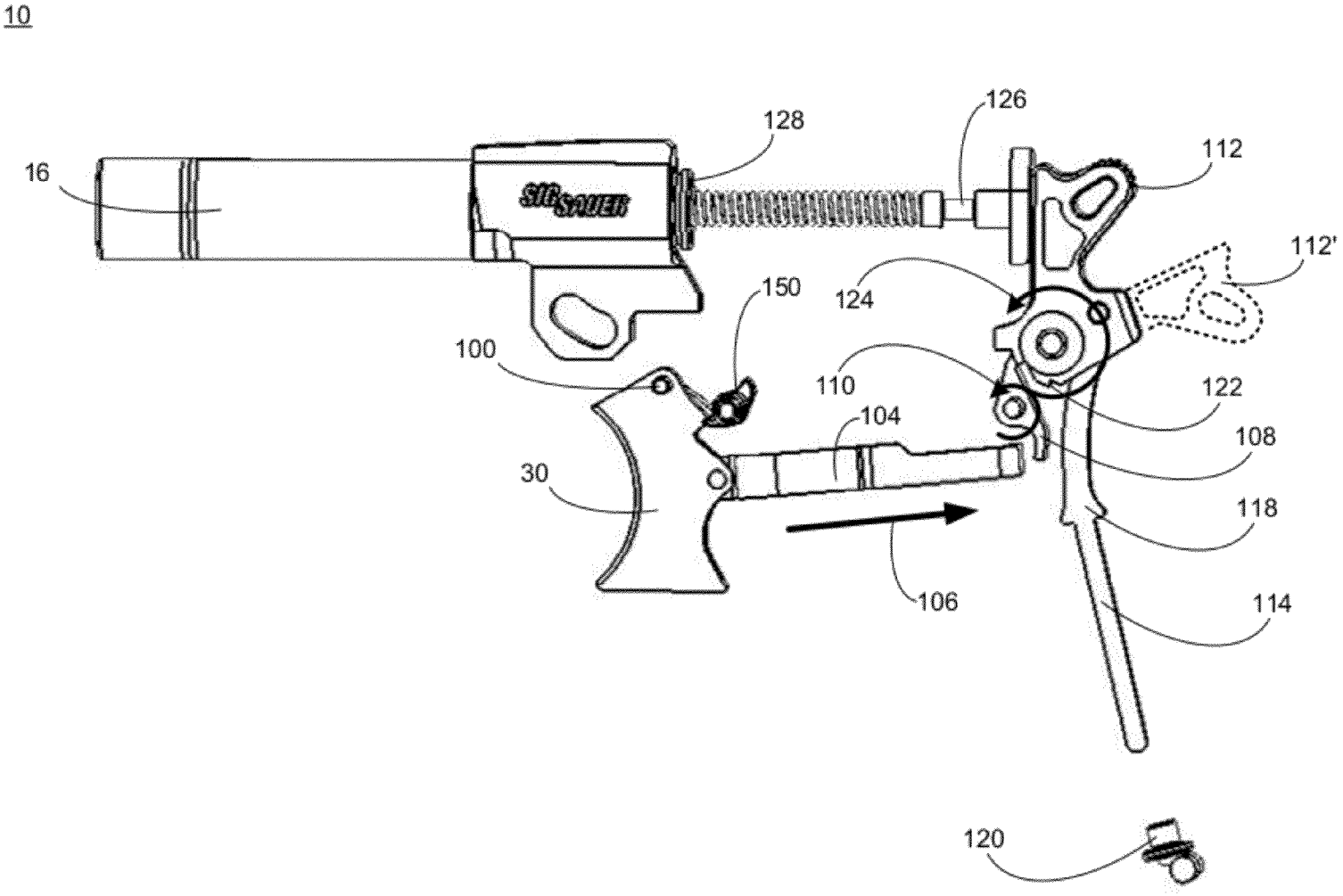
FIG. 6 is another detail view of the firearm including the magazine safety assembly of FIG. 1.
Figure 8:
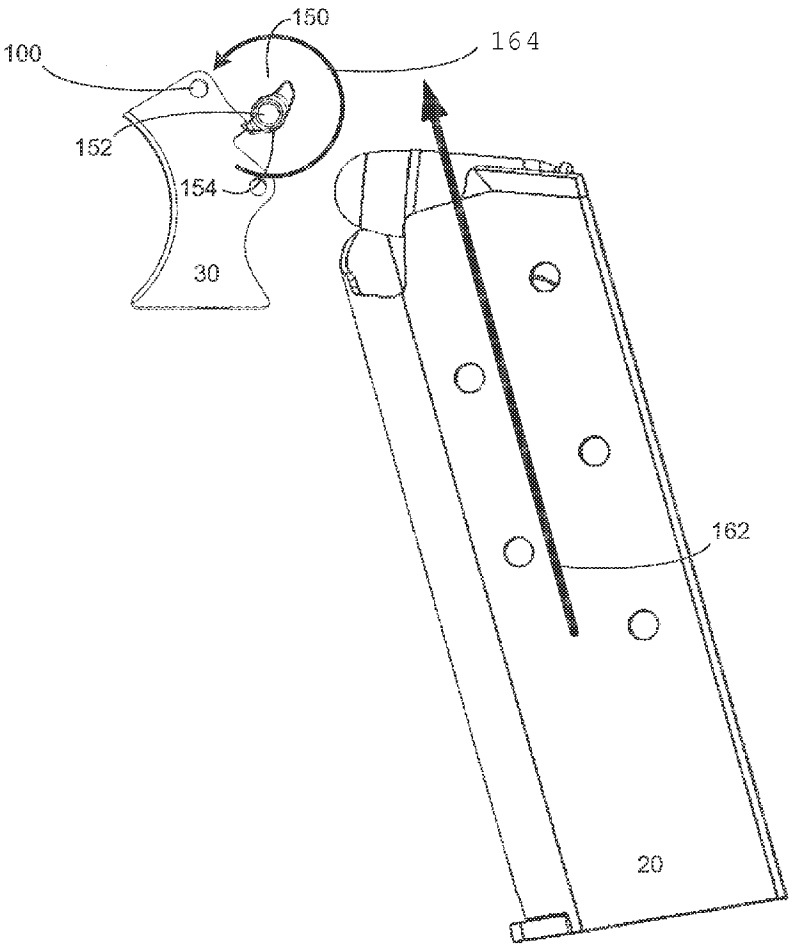
FIG. 8 is a detail view of the magazine safety assembly of FIG. 1 in a disengaged position.

Referring to FIGS. 4-6, there is shown a detail view of firearm 10 with various components of firearm 10 removed (e.g. frame assembly 12 and slide assembly 14, as shown in FIGS. 1-3) to allow for viewing of the various internal components of firearm 10. Trigger assembly 30 may be configured to pivot about pivot point 100 to allow for trigger assembly 30 to be displaced in a counterclockwise fashion (in the direction of arrow 102) as a user (not shown) depresses trigger assembly 30. Alternatively, a non-pivoting trigger assembly (not shown) may be utilized within firearm 10.

As trigger assembly 30 rotates in a counterclockwise fashion, trigger bar 104 may be displaced longitudinally (in the direction of arrow 106), which displaces sear assembly 108 in a counterclockwise fashion (in the direction of arrow 110), thus disengaging sear assembly 108 from hammer assembly 112.

Hammer assembly 112 may be biased into the uncocked position (as shown in FIGS. 4-6) via the combination of strut rod 114 and hammer spring 116 (which is held captive between strut rod flange 118 and spring retainer 120). When hammer assembly 112 is placed into the cocked position, sear assembly 108 may hold hammer assembly 112 in the cocked position (as illustrated via cocked hammer assembly 112') by releasably engaging notch 122 of hammer assembly 112. Accordingly, when sear assembly 108 is displaced (in the direction of arrow 110), sear assembly 108 may disengage notch 122, resulting in hammer assembly 112 rotating in a counterclockwise fashion (in the direction of arrow 124 due to the bias of hammer spring 116) from the cocked position (as illustrated via cocked hammer assembly 112') to the uncocked position (as illustrated via hammer assembly 112), which may result in hammer assembly 112 striking firing pin 126 that may impact cartridge 128 and discharge firearm 10.

Figure 9:
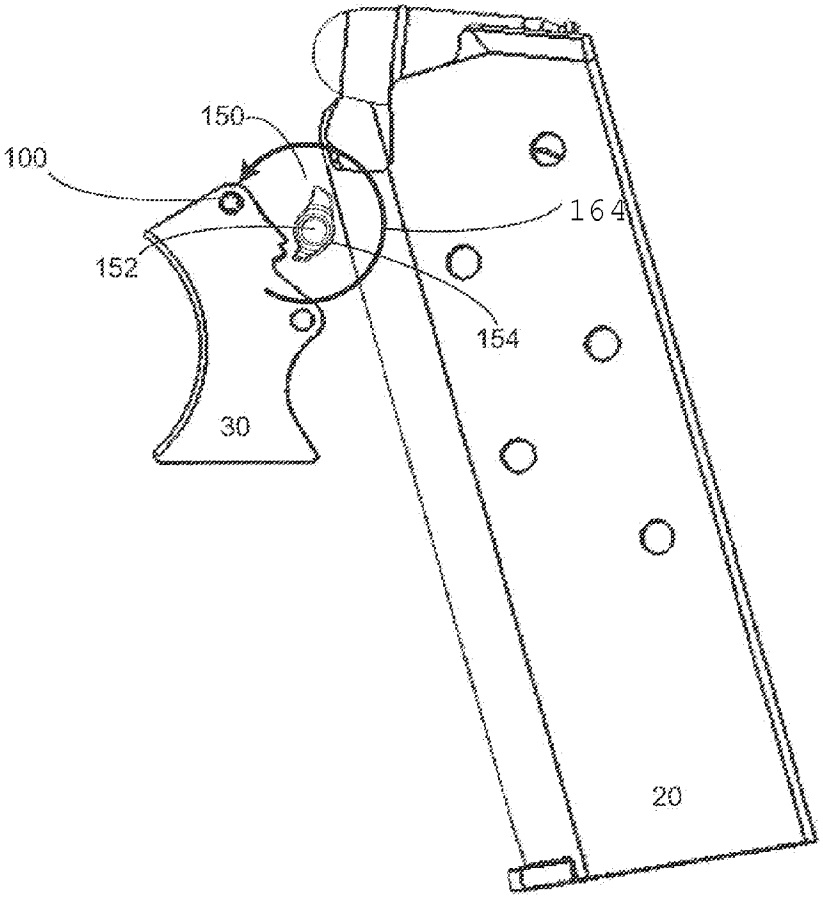
FIG. 9 is a detail view of the magazine safety assembly of FIG. 1 in an engaged position.

Referring to FIGS. 7A-7E, 8 & 9, firearm 10 may include magazine safety assembly 150 configured to prevent firearm 10 from discharging when ammunition magazine assembly 20 is not positioned within (i.e., inserted into) magazine well 34. Magazine safety assembly 150 may include pivot point assembly 152 (e.g., a pin assembly) and lever assembly 154. Lever assembly 154 may include first portion 156 and second portion 158. Lever assembly 154 may be configured to pivot about pivot point assembly 152 from an engaged position (as shown in FIGS. 7A-7D & 8) to a disengaged position (as shown in FIGS. 4 & 9). Magazine safety assembly 150 may be configured so that first portion 156 of lever assembly 154 prohibits displacement of trigger assembly 30 when lever assembly 154 is in the engaged position (as shown in FIGS. 7A-7D & 8).

When magazine safety assembly 150 is positioned in the engaged position (as shown in FIGS. 7A-7D & 8), first portion 156 of lever assembly 154 may releasably engage trigger assembly 30 of firearm 10. When magazine safety assembly 150 is positioned in the disengaged position (as shown in FIGS. 4 & 9), second portion 158 of lever assembly 154 may releasably engage ammunition magazine assembly 20 when ammunition magazine assembly 20 is positioned within magazine well 34 of firearm 10. Spring assembly 160 may be configured to bias lever assembly 154 into the engaged position (as shown in FIGS. 7A-7D & 8) when ammunition magazine assembly 20 is not positioned within magazine well 34 of firearm 10. Spring assembly 160 at least partially surrounds pivot point assembly 152 and contacts pivot point 100 of trigger 30.

Magazine safety assembly 150 may be configured so that lever assembly 154 is displaced (in the direction of arrow 164) from the engaged position (as shown in FIGS. 7A-7D & 8) to the disengaged position (as shown in FIGS. 4 & 9) when ammunition magazine assembly 20 is inserted (in the direction of arrow 162) into magazine well 34 of firearm 10. Accordingly, first portion 156 of lever assembly 154 may be configured to disengage trigger assembly 30 when ammunition magazine assembly 20 is inserted into magazine well 34 of firearm 10 (thus positioning lever assembly 154 into the disengaged position, as shown in FIGS. 4 & 9).

While magazine safety assembly 150 is shown to include first portion 156 of lever assembly 154 that directly engages trigger assembly 30 of firearm 10, other configurations are possible and are considered to be within the scope of this disclosure. For example, first portion 156 of lever assembly 154 may directly engage a supplemental linkage assembly (not shown) that may be configured to directly engage trigger assembly 30.

Having thus described the disclosure of the present application in detail and by reference to embodiments thereof, it will be apparent that modifications and variations are possible without departing from the scope of the disclosure defined in the appended claims.

What is claimed is:

1. A magazine safety assembly comprising:

a pivot point assembly;

a lever assembly, including a first portion and a second portion, the lever assembly being configured to pivot about the pivot point assembly from an engaged position to a disengaged position, wherein:

when positioned in the engaged position, the first portion of the lever assembly is configured to directly and releasably engage a trigger, and when positioned in the disengaged position, the second portion of the lever assembly is configured to releasably engage an ammunition magazine assembly positioned within a magazine well; and a spring assembly configured to bias the lever assembly into the engaged position when the ammunition magazine assembly is not positioned within the magazine well, wherein the spring assembly at least partially surrounds the pivot point assembly and contacts a pivot point of the trigger.

2. The magazine safety assembly of claim 1 wherein the lever assembly is configured to be displaced from the engaged position to the disengaged position when the ammunition magazine assembly is inserted into the magazine well.

3. The magazine safety assembly of claim 1 wherein the first portion of the lever assembly is configured to prohibit displacement of the trigger when the lever assembly is in the engaged position.

4. The magazine safety assembly of claim 1 wherein the first portion of the lever assembly is configured to disengage the trigger when the lever assembly is in the disengaged position.

5. The magazine safety assembly of claim 1 wherein the pivot point assembly includes a pin assembly.

6. The magazine safety assembly of claim 1 further comprising a linkage assembly for coupling the trigger to a hammer assembly.

7. The magazine safety assembly of claim 6 wherein the linkage assembly includes a trigger bar and a sear assembly.

8. The magazine safety assembly of claim 1 wherein the magazine safety assembly is included in a handgun.

9. A firearm comprising:

a linkage assembly for coupling a trigger to a hammer assembly;

a lever assembly, including a first portion and a second portion, the lever assembly being configured to pivot from an engaged position to a disengaged position without contacting the linkage assembly, wherein:

when positioned in the engaged position, the first portion of the lever assembly is configured to directly and releasably engage the trigger, and when positioned in the disengaged position, the second portion of the lever assembly is configured to releasably engage an ammunition magazine assembly positioned within a magazine well; and a spring assembly configured to bias the lever assembly into the engaged position when the ammunition magazine assembly is not positioned within the magazine well, wherein the spring assembly at least partially surrounds a pivot point assembly about which the lever assembly is configured to pivot, and wherein the spring assembly contacts a pivot point of the trigger.

10. The firearm of claim 9 wherein the lever assembly is configured to be displaced from the engaged position to the disengaged position when the ammunition magazine assembly is inserted into the magazine well.

11. The firearm of claim 9 wherein the first portion of the lever assembly is configured to prohibit displacement of the trigger when the lever assembly is in the engaged position.

12. The firearm of claim 9 wherein the first portion of the lever assembly is configured to disengage the trigger when the lever assembly is in the disengaged position.

13. The firearm of claim 9 wherein the linkage assembly includes a trigger bar and a sear assembly.

14. The firearm of claim 9 wherein the firearm is a handgun.

15. A magazine safety assembly comprising:

a pivot point assembly;

a lever assembly configured to pivot about the pivot point assembly from an engaged position to a disengaged position, wherein:

when positioned in the engaged position, the lever assembly is configured to directly and releasably engage a trigger assembly, and when positioned in the disengaged position, the lever assembly is configured to releasably engage an ammunition magazine assembly positioned within a magazine well and disengage the trigger assembly; and a spring assembly configured to bias the lever assembly into the engaged position when the ammunition magazine assembly is not positioned within the magazine well, wherein the spring assembly directly contacts the trigger assembly, wherein the spring assembly at least partially surrounds the pivot point assembly and contacts a pivot point of the trigger.

16. The magazine safety assembly of claim 15 wherein the lever assembly is configured to be displaced from the engaged position to the disengaged position when the ammunition magazine assembly is inserted into the magazine well.

17. The magazine safety assembly of claim 15 wherein the lever assembly is configured to prohibit displacement of the trigger assembly when the lever assembly is in the engaged position.

18. The magazine safety assembly of claim 15 further comprising a linkage assembly for coupling the trigger assembly to a hammer assembly.

19. The magazine safety assembly of claim 18 wherein the linkage assembly includes a trigger bar and a sear assembly.

20. The magazine safety assembly of claim 15, wherein when the ammunition magazine assembly is positioned within the magazine well, the lever assembly is configured to disengage from direct contact with the trigger assembly.

* * * * *